US010674847B1

(12) United States Patent
Lytle

(10) Patent No.: US 10,674,847 B1
(45) Date of Patent: Jun. 9, 2020

(54) PERSONAL ASSISTANCE ACCESSORY FOR DINNERWARE

(71) Applicant: Maryann Lytle, Clearwater, FL (US)

(72) Inventor: Maryann Lytle, Clearwater, FL (US)

( * ) Notice: Subject to any disclaimer, the term of this patent is extended or adjusted under 35 U.S.C. 154(b) by 0 days.

(21) Appl. No.: 16/552,198

(22) Filed: Aug. 27, 2019

(51) Int. Cl.
*A47G 19/02* (2006.01)
*F21V 33/00* (2006.01)
*F21Y 115/10* (2016.01)

(52) U.S. Cl.
CPC ..... *A47G 19/02* (2013.01); *F21V 33/0036* (2013.01); *A47G 2200/08* (2013.01); *F21Y 2115/10* (2016.08)

(58) Field of Classification Search
CPC ..... A47G 19/02; F21V 33/0036
USPC ..... 362/154
See application file for complete search history.

(56) References Cited

U.S. PATENT DOCUMENTS 2,178,812 A 11/1939 Schade
3,598,278 A * 8/1971 Vann, Jr. ..... A47G 19/02 220/574.1
3,705,982 A 12/1972 Smolinski
5,307,250 A * 4/1994 Pearson ..... A47G 23/0309 200/85 R
5,430,628 A * 7/1995 Saunders ..... A47G 23/06 362/154
6,092,905 A * 7/2000 Koehn ..... A47G 23/0216 362/101
6,152,575 A 11/2000 Montanino
6,352,352 B1 * 3/2002 Schletterer ..... A47G 19/2227 320/167
6,379,018 B1 * 4/2002 Rycroft ..... A47G 23/0309 362/101
6,676,269 B1 * 1/2004 Dorney ..... A47G 19/2227 362/101
7,163,311 B2 1/2007 Kramer
8,444,288 B1 5/2013 Leal
2006/0158867 A1 * 7/2006 Lee ..... A47G 19/025 362/84
2006/0158870 A1 * 7/2006 Lee ..... A47G 19/025 362/109
2006/0158886 A1 * 7/2006 Lee ..... A47G 19/025 362/318
2009/0179038 A1 * 7/2009 Wong ..... A47G 19/02 220/731

(Continued)

OTHER PUBLICATIONS

Myplate food portion plate with colored portion areas; web page first published on amazon.com Dec. 20, 2017.

(Continued)

*Primary Examiner* — Bryon T Gyllstrom
(74) *Attorney, Agent, or Firm* — John V. Stewart

(57) ABSTRACT

A wall of material around the rim of a dinner plate, bowl, or drinking glass. A light emitter and battery are removably or integrally attached to the wall. The light emitter may emit different colored lighting from different circumferential sections of the wall toward food or drink in the dinnerware. A removable version of the wall may be C-shaped, with a circumferential groove on an inner surface of the wall that receives the rim of the dinnerware. Mirrors on the wall may reflect the light inward toward food in the dinnerware, and may direct some of the light across the gap in a C-shaped wall. The wall may be translucent or transparent, with the emitter and battery attached to an outer surface of the wall.

14 Claims, 6 Drawing Sheets

(56) References Cited

U.S. PATENT DOCUMENTS

| | | | | |
|---|---|---|---|---|
| 2012/0127699 | A1* | 5/2012 | Chang | A47G 19/2227<br>362/101 |
| 2016/0183731 | A1* | 6/2016 | Merkazy | A47J 43/24<br>210/239 |

OTHER PUBLICATIONS

Snap-on plastic ring food guard; web page published on amazon.com; first publication date not known.

* cited by examiner

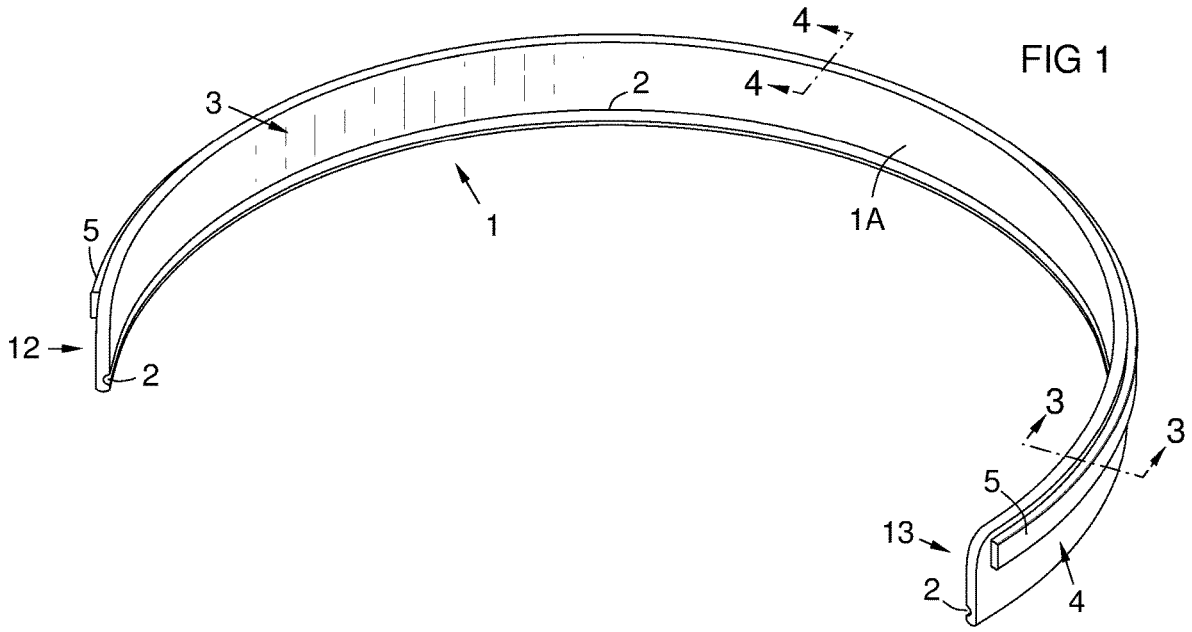
FIG 1
FIG 2
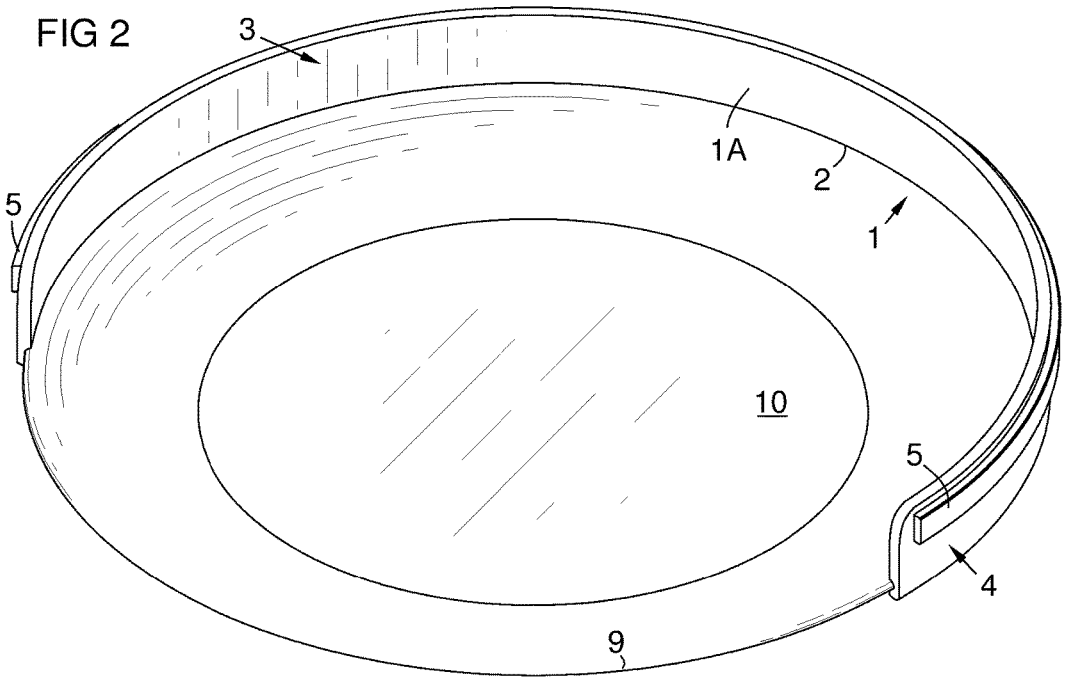

PERSONAL ASSISTANCE ACCESSORY FOR DINNERWARE

FIELD OF THE INVENTION

The invention relates to accessories for dinner plates, bowls, and glasses that assist the elderly, the visually impaired, and disabled persons, and relates particularly to illumination devices and plate rim risers that assist in scooping food into an eating utensil.

BACKGROUND OF THE INVENTION

People with visual impairments, and those with trembling hands, have difficulty eating from standard tableware. They cannot see the food clearly and/or cannot control eating utensils to scoop the food. They tend to push it around and sometimes off the plate.

Assistive plates and bowls are available with a raised back rim portion that facilitates scooping food into an eating utensil by pushing the food against the raised rim. Such risers, also called rim guards, are available integrally or attachable to plates and bowls.

However, a remaining problem is that a visually impaired person may not clearly see the location and position of the plate, the raised rim, and the boundaries and types of food portions in the plate.

SUMMARY OF THE INVENTION

An objective of the invention is to provide a lighted rim around a food plate, bowl, or drinking glass to assist the visually impaired.

Another objective is to provide a raised rim around a plate or bowl to assist in scooping food into an eating utensil.

Another objective is to illuminate and clarify food portions in a plate or bowl.

Another objective is to use colored lighting to indicate a type of food in each portion of a plate.

Another objective is to make the accessory easily attachable to dinnerware.

Another objective is to provide a battery and lights that are removable to allow placing the accessory in a microwave oven and a dishwasher.

BRIEF DESCRIPTION OF THE DRAWINGS

The invention is explained in the following description in view of the drawings that show:

FIG. 1 is an isometric top view of a dining plate rim riser according to aspects of the invention.

FIG. 2 is a top front view of the rim riser of FIG. 1 attached to a dinner plate.

DETAILED DESCRIPTION OF THE INVENTION

Figure 3:
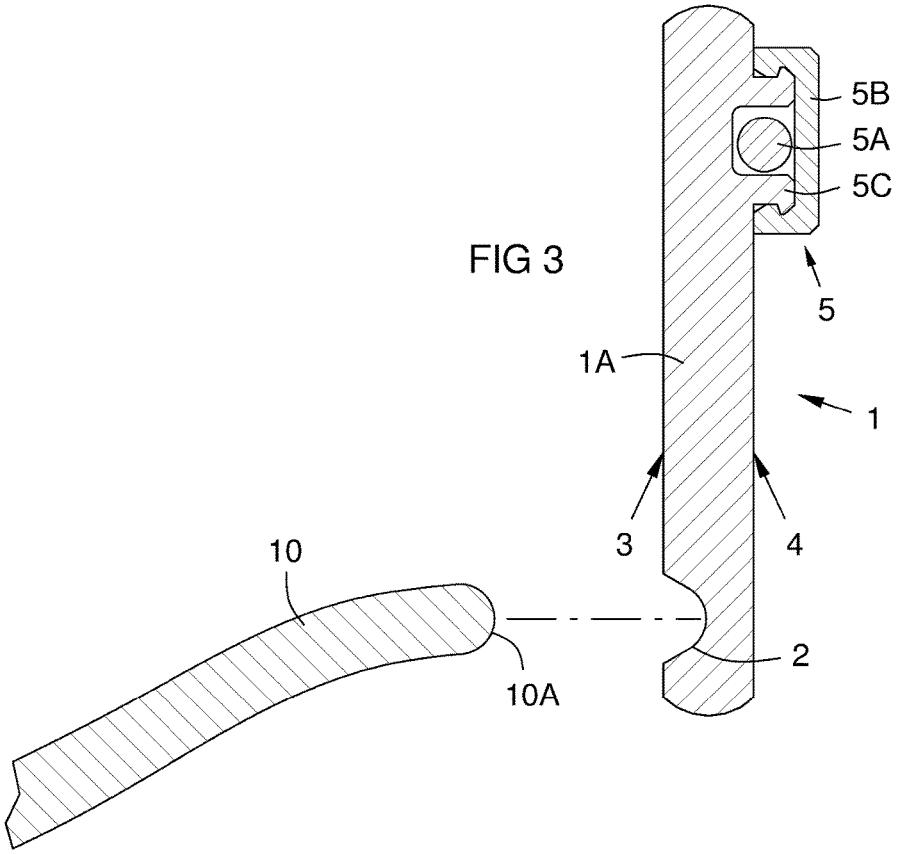
FIG. 3 is a sectional view taken along line 3-3 of FIG. 1 showing a light emitter.

FIG. 1 shows an attachable accessory 1, comprising a wall 1A that is C-shaped as seen in a top view. It attaches to the rim of a plate as seen in FIG. 2. A circumferential groove 2 around a lower portion of the inner surface 3 of the wall receives the rim of a food plate or bowl when the C-shaped wall is flexibly spread then released to clamp around the rim. A light emission element 5 is attached around the wall. For example, a string of battery-powered light bulbs may be attached circumferentially from end 12 to end 13 around an upper portion of the outer surface 4 of the wall. Light emitting diodes (LEDs) may be used.

The material of the wall 1A is preferably transparent or translucent plastic that is flexible enough to spread for plates, bowls, or glasses in a range of diameters, and yet is stiff enough to provide clamping force on those diameters. For example, polycarbonate or silicone may be used. The circumferential length of the accessory wall should be greater than 180 degrees of the circumferential rim length of the largest plate within its range. So, it should be greater than pi*D/2, where D is the diameter of the largest plate in the range. For example, an accessory for 8 to 10-inch plates should have a circumferential length greater than 15.7 inches (3.1416*10/2).

FIG. 2 shows the accessory 1 attached to the rim 9 of a dinner plate 10. This allows food in the plate to be pushed against the wall by an eating utensil to scoop the food into the utensil. The light emitter 5 illuminates the wall, clarifying the boundaries of the plate. Some of the light illuminates food in the plate laterally, producing highlights and shadows that clarify the contours of the food. The inner surface 3 may be vertical, or it may lean inwardly up to 40 degrees. Herein, "inwardly" means proximally toward the center of major curvature of the wall. The wall 1A may be concave inward instead of planar. In an alternate embodiment, the wall 1A may be integrally formed with the plate, and may be C-shaped or may fully encircle the plate.

FIG. 3 is a sectional view taken along line 3-3 of FIG. 1, showing a light emitter 5, comprising a string of LEDs 5A enclosed in a removable cover 5B. The cover material may be flexible enough to allow spreading over hooked rails 5C. For example, a silicone material may be used. The rim 10A of a plate or bowl 10 is received in the circumferential slot 2 in the inner surface 3 of the wall 1A. The light emitter 5 may be in the upper half of the wall to shine laterally and downward onto food in the plate for best coverage. The slot 2 may be formed in the lower half or the lower ¼ of inner surface 3 the wall.

Figure 4:
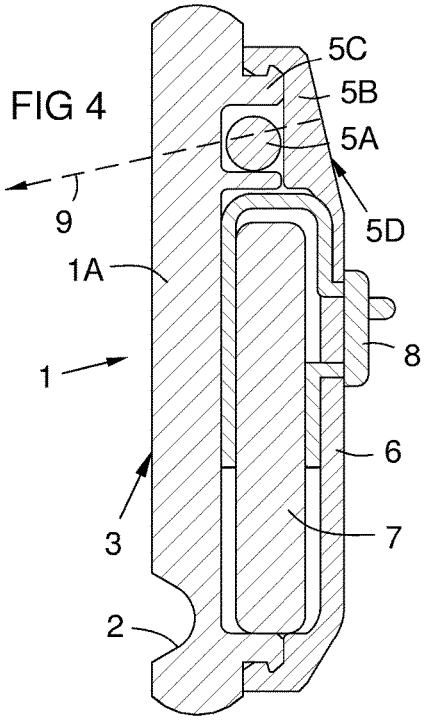
FIG. 4 is a sectional view taken alone line 4-4 of FIG. 1 showing a battery.

FIG. 4 is a sectional view taken along line 4-4 of FIG. 1 showing the cover 5B expanded to include a battery compartment 6 for one or more batteries 7, which may be coin batteries, and may be rechargeable. The cover 5B may be removable to separate the lights 5A and batteries 7 from the wall 1A for washing the wall in a dishwasher. To simplify removal and reattachment of the LEDs 5A and the cover 5B, the LEDs may be bonded to, or incorporated into, the cover. One or more manual switches 8 may be provided to activate the lights.

The outer surface 5D of the light cover 5B may be angled inward and downward and coated with a reflective material to reflect light 9 from the LEDs inward and downward toward the food. For example, the surface 5D may comprise a thin metal layer applied by vapor deposition to form a second-surface mirror. The metal may be fully reflective, or it may be thin enough to allow some light to pass through for visibility and ornamentation. The reflective layer may be overcoated with polyester or other durable material to preserve and retain the metal.

Figure 5:
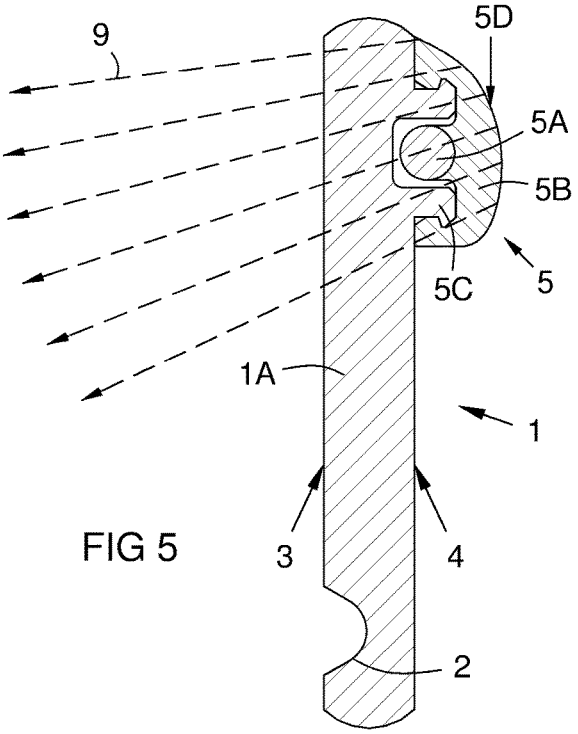
FIG. 5 is a sectional view as in FIG. 3 with a convex second-surface reflector.

FIG. 5 is a sectional view as in FIG. 3 in an embodiment with a concave second-surface mirror 5D shaped to reflect light 9 from the LEDs 5A inward and downward toward the food on the plate. The mirror is formed on a convex outer surface of the cover 5B. The outer surface of the cover may comprise a single approximately toroidal surface around the whole circumferential length of the cover or it may comprise a series of bumps that provide an individual spherical or aspherical mirror for each respective bulb. Alternately, the mirror may be formed of Fresnel elements, for example as parallel or concentric bands of different surface angles to minimize the thickness of the cover 5B. The LEDs 5A may be bonded to, or encapsulated in, the cover 5B for easy removal and reattachment of the lighting 5.

Figure 6:
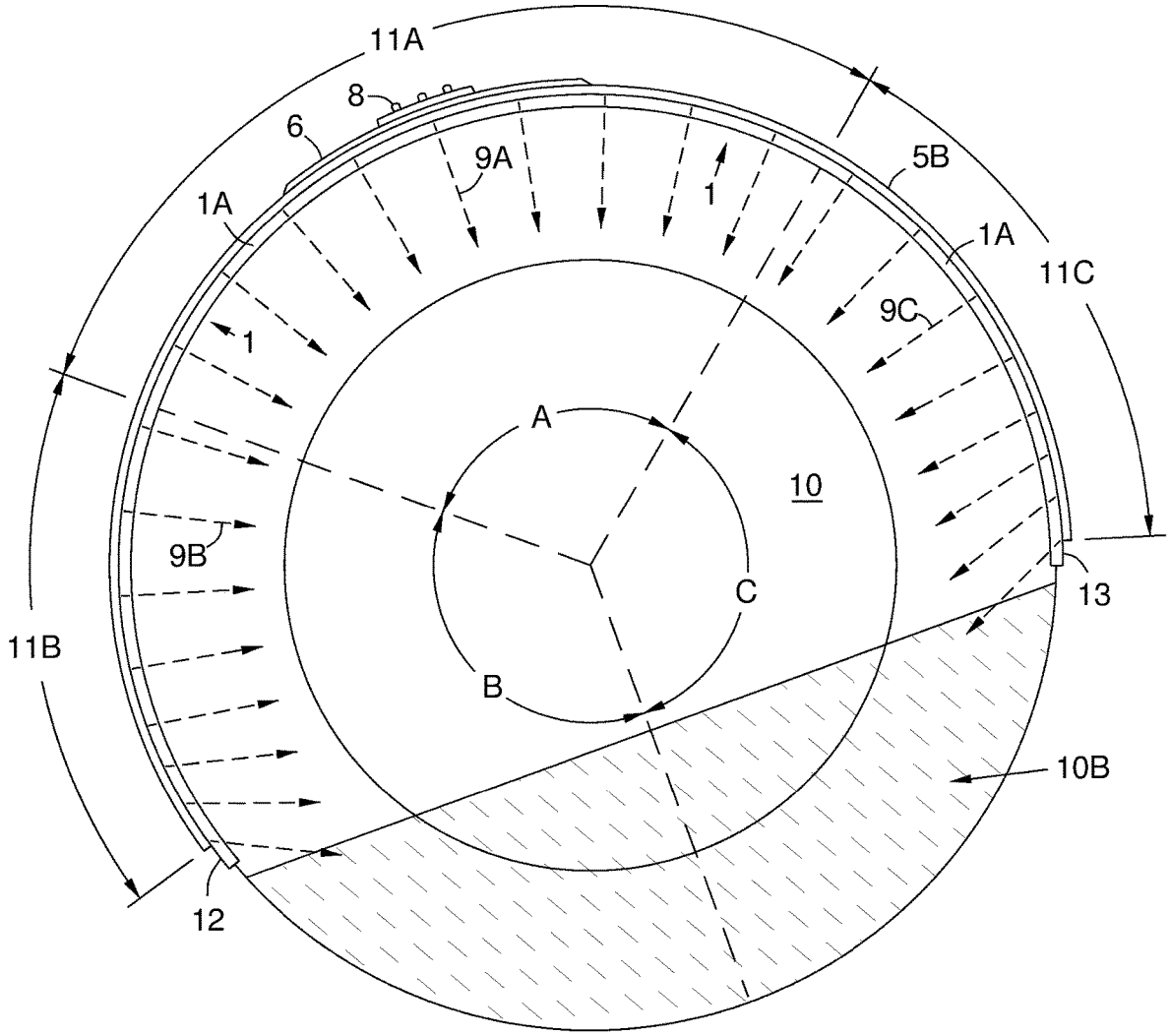
FIG. 6 is a top view of the rim riser and plate of FIG. 2, showing directed lighting.

FIG. 6 is a top view of the accessory 1 on a plate 10. Three food portion areas A, B, and C are shown. Lighting of different colors 9A, 9B, 9C may be provided in respective circumferential sections 11A, 11B, 11C of the emitter for each area. Light bulbs may be spaced closer together near the two ends 12, 13 of the wall 1A than in a middle portion thereof to increase lighting across a gap between the ends of the wall. Reflectors on the emitter cover 5B as previously described may direct lighting near the two ends 12, 13 across the gap and forward to cover a portion of the plate 10B (hatched) that extends between and forward of the gap.

One or more strings of LEDs 5A of different colors may cover respective sections along the circumferential length of the wall 1A. For example, an edible greens section may be lit green; a starch section may be lit yellow; other vegetables may be lit blue; meat, fish, and poultry may be lit white or pink. With a single string of LEDs, the circumferential section colors are fixed. With multiple strings, the section colors may be selectable by multiple switches 8. For example, a protein zone may be selectable between red to represent red meat, pink to represent poultry, and white to represent seafood. Other lighting technology may be used instead of LED's, including for example flat panel display technology. As an alternate to different colored LED's the C-shaped wall may have different colored sections or films acting as light filters.

Figure 7:
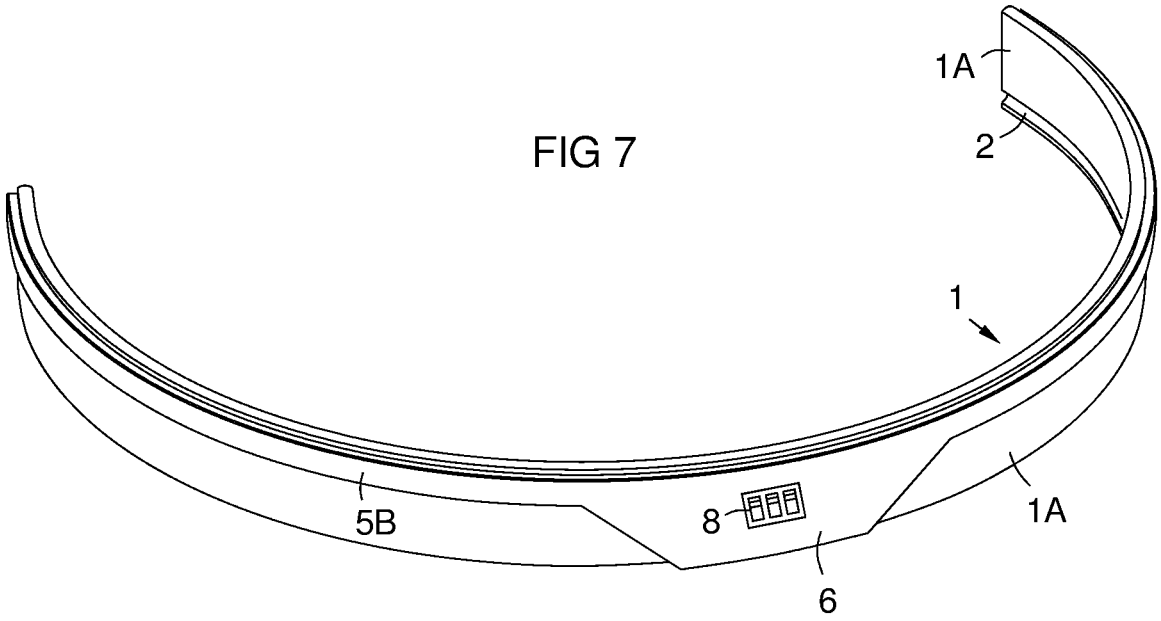
FIG. 7 is a top back view of the rim riser of FIG. 1 showing a battery compartment.
Figure 8:
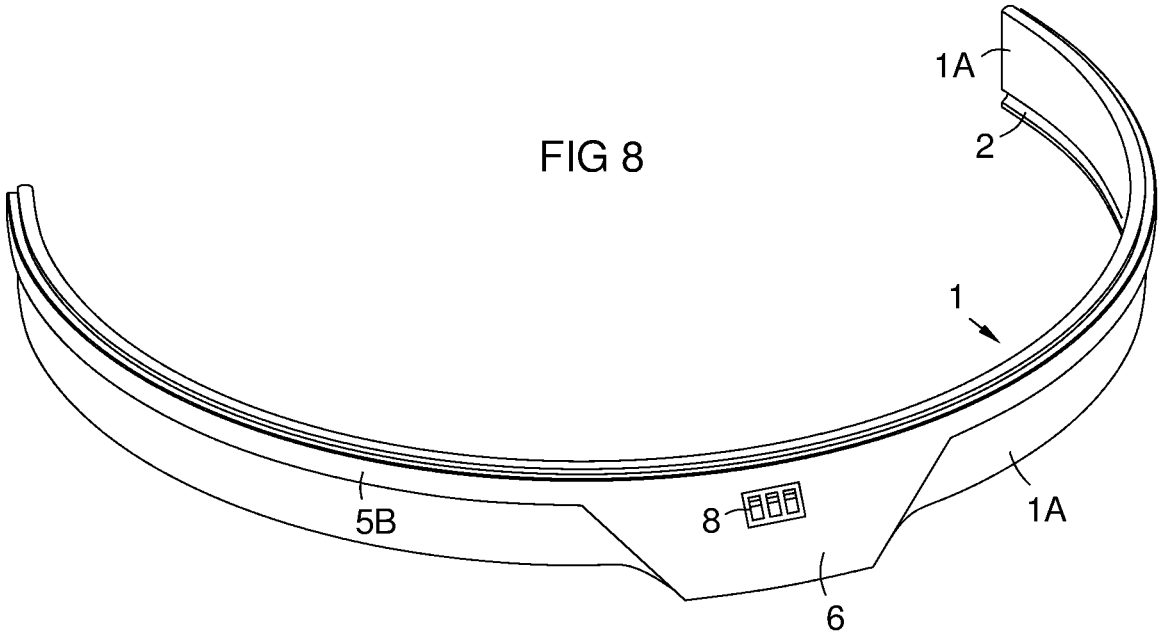
FIG. 8 is a view as in FIG. 7 showing a downwardly extended battery compartment.

FIG. 7 is a top back view of the accessory of FIG. 1 showing a battery compartment 6 and switches 8. FIG. 8 is a view as in FIG. 7 showing a downwardly extended battery compartment 6 for larger batteries.

Figure 9:
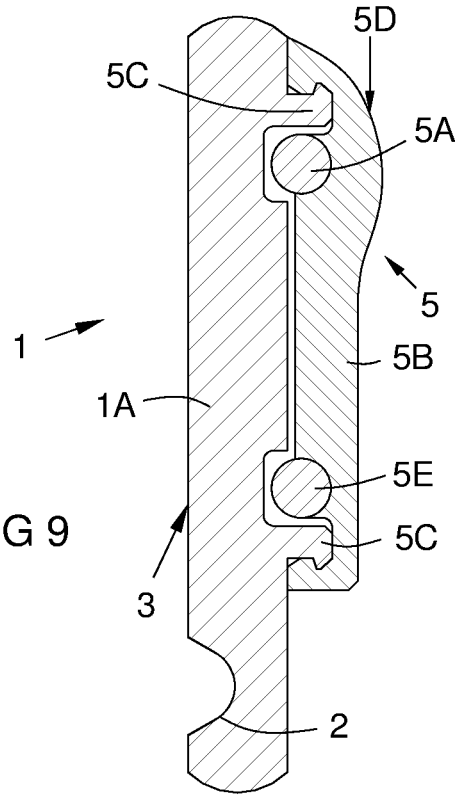
FIG. 9 is a view as in FIG. 5 showing upper and lower lighting elements.

FIG. 9 is a sectional view of an embodiment with both upper 5A and lower 5E lights, which may be the same color in each circumferential section of the wall. Alternately, the upper lights in all sections may be the white to illuminate the food, while the lower lights may provide a different color per section to designate a food type. Alternately, two or more strings of lights may each provide a different combination of colors per section to designate different food types per portion depending on the menu.

Figure 10:
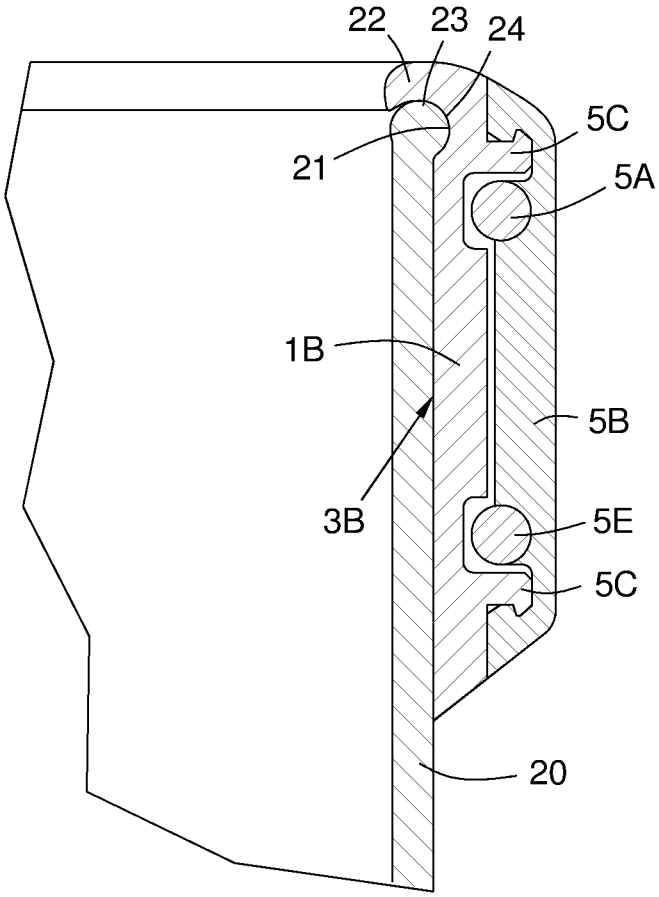
FIG. 10 is a sectional view of an embodiment of the accessory on a drinking glass.

FIG. 10 is a sectional view of an accessory with a wall 1B attached to the rim 23 of a drinking glass 20. A circumferential groove 21 near the top of the inner surface 3B of the wall 1B accepts an outwardly extending rounded lip 24, if any, of the rim 23 as shown. An overhang 22 may be provided that overlaps the rim 23 of the drinking glass and supports the wall regardless of the presence of an outwardly rounded lip 24 on the rim of the glass.

Figure 11:
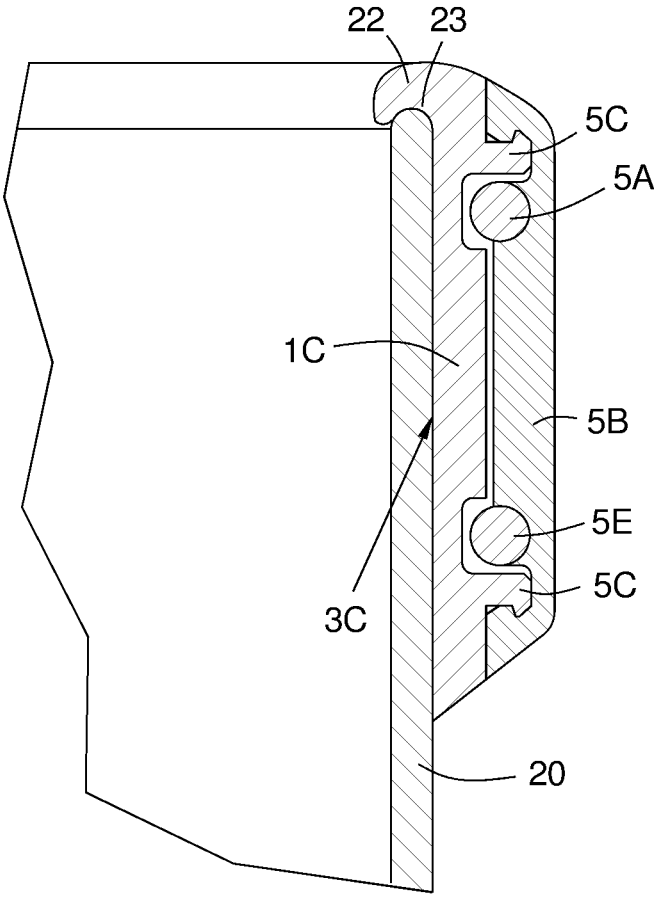
FIG. 11 is a sectional view of another embodiment on a drinking glass.

FIG. 11 is a sectional view of another wall embodiment 1C mounted on a drinking glass with a rim 23 with no outwardly extending rounded lip. This embodiment does not require a circumferential groove in the inner surface 3C of the C-shaped wall because the overhang 22 retains the C-shaped wall 1C on the rim 23 of the drinking glass.

While various embodiments of the present invention are shown and described herein, such embodiments are provided as examples only. Variations and substitutions may be made by those skilled in the art without departing from the invention herein. Accordingly, the invention is to be limited only by the scope and intended meaning of the appended claims.

The invention claimed is:

1. An accessory for dinnerware, comprising:

a wall of material that is C-shaped as seen in a top view, comprising first and second ends, an inner surface and an outer surface;

wherein the inner surface is vertical or leans inwardly; and a light emitter disposed circumferentially around the wall from the first end to the second end thereof;

wherein the C-shaped wall is attachable to or integral with the rim of a food dish, bowl, or drinking glass; and wherein the C-shaped wall is transparent or translucent, and the light emitter and a battery compartment are enclosed in a removable cover on the outer surface of the C-shaped wall.

2. The accessory of claim 1, further comprising:

a circumferential groove around the inner surface of the C-shaped wall;

wherein the C-shaped wall is attachable to the rim of a food dish, bowl, or drinking glass by flexing the wall and releasing it with said rim in the circumferential groove.

3. The accessory of claim 2, wherein:

the circumferential groove is disposed around a lower portion of the inner surface of the C-shaped wall; and the light emitter comprises 3 or 4 circumferential sections on the C-shaped wall that emit light in 3 or 4 respective colors, one color for each of the circumferential sections.

4. The accessory of claim 1, wherein:

the light emitter is disposed on an upper portion of the C-shaped wall; and further comprising one or more mirrors on the C-shaped wall that reflect light from the light emitter inwardly and downward from the C-shaped wall.

5. The accessory of claim 4, wherein said one or more mirrors direct some of the light from the light emitter from locations proximate the two ends of the C-shaped wall toward a gap area between said two ends and outward from said gap area.

6. The accessory of claim 1, further comprising an overhang extending inwardly around the top of the C-shaped wall, wherein the C-shaped wall can be spread apart then released around a rim of a drinking glass with the overhang resting atop the rim of the drinking glass.

7. An accessory for dinnerware, comprising:

a wall of material that is C-shaped as seen in a top view, comprising two ends, an inner surface and an outer surface;

a circumferential groove around the inner surface; and a light emitter disposed circumferentially around an upper portion of the wall;

wherein the C-shaped wall clamps onto the rim of a food dish, bowl, or glass when the C-shaped wall is flexed then released with the rim in the circumferential groove wherein:

the circumferential groove is disposed around a lower portion of the inner surface; and the light emitter comprises 3 or 4 circumferential sections on the C-shaped wall that emit light in 3 or 4 respective colors, one color per section.

8. The accessory of claim 7, wherein the C-shaped wall is transparent or translucent, and the light emitter and a battery compartment are encased in, and attached to, a removable cover on the outer surface of the C-shaped wall.

9. The accessory of claim 7, further comprising a mirror on the wall that reflects light from the bulbs inward and downward.

10. The accessory of claim 7, wherein the C-shaped wall is transparent or translucent, and the light emitter comprises one or more strings of light bulbs and a battery compartment, all encased in a removable cover on the outer surface of the C-shaped wall.

11. The accessory of claim 10, wherein the bulbs are spaced closer together near the two ends of the C-shaped wall than in a middle portion thereof.

12. The accessory of claim 11, further comprising:

a plurality of mirrors on the removable cover that reflect light from the bulbs inward and downward; and some of the mirrors reflect light from ones of the bulbs proximate the two ends of the C-shaped wall to shine across an area between and forward of a gap between the two ends of the C-Shaped wall.

13. An accessory for dinnerware, comprising:

a wall of material that is C-shaped as seen in a top view, comprising two ends, an inner surface and an outer surface;

a circumferential groove around the inner surface; and a light emitter disposed circumferentially around an upper portion of the wall;

wherein the C-shaped wall clamps onto the rim of a food dish, bowl, or glass when the C-shaped wall is flexed then released with the rim in the circumferential groove;

wherein the circumferential groove is proximate a top end of the inner surface, and is sized to receive an outwardly extending rounded lip on a rim of a drinking glass.

14. An accessory for dinnerware, comprising:

a wall of material that is C-shaped as seen in a top view, comprising two ends, an inner surface and an outer surface;

a circumferential groove around the inner surface; and a light emitter disposed circumferentially around an upper portion of the wall;

wherein the C-shaped wall clamps onto the rim of a food dish, bowl, or glass when the C-shaped wall is flexed then released with the rim in the circumferential groove;

wherein the light emitter is attached to the outer surface of the C-shaped wall; and the C-shaped wall comprises differently colored circumferential sections of a light filtering material.

* * * * *